US008437860B1

(12) United States Patent
Crawford et al.

(10) Patent No.: US 8,437,860 B1
(45) Date of Patent: May 7, 2013

(54) HEARING ASSISTANCE SYSTEM

(75) Inventors: Scott A. Crawford, Castaic, CA (US); Lee F. Hartley, Valencia, CA (US)

(73) Assignee: Advanced Bionics, LLC, Valencia, CA (US)

( * ) Notice: Subject to any disclaimer, the term of this patent is extended or adjusted under 35 U.S.C. 154(b) by 498 days.

(21) Appl. No.: 12/568,851

(22) Filed: Sep. 29, 2009

Related U.S. Application Data

(60) Provisional application No. 61/102,726, filed on Oct. 3, 2008.

(51) Int. Cl.
*H04R 25/00* (2006.01)

(52) U.S. Cl.
USPC ..... 607/55; 607/1; 607/2; 607/56; 607/57; 607/115; 607/116; 607/118; 607/136; 607/137; 607/139

(58) Field of Classification Search ..... 607/1–2, 607/55–57, 115–116, 118, 136–137, 139
See application file for complete search history.

(56) References Cited

U.S. PATENT DOCUMENTS

| | | | |
|---|---|---|---|
| 4,315,111 | A | 2/1982 | Thomas |
| 4,467,145 | A | 8/1984 | Borstel |
| 4,751,485 | A | 6/1988 | Fujio et al. |
| 4,879,443 | A | 11/1989 | Carlucci et al. |
| 4,918,737 | A | 4/1990 | Luethi |
| 5,553,152 | A | 9/1996 | Newton |
| 5,659,621 | A | 8/1997 | Newton |
| 5,824,022 | A | 10/1998 | Zilberman et al. |
| 5,945,929 | A | 8/1999 | Westra |
| 5,948,006 | A | 9/1999 | Mann |
| 6,269,266 | B1 | 7/2001 | Leysieffer |
| 6,272,382 | B1 | 8/2001 | Faltys et al. |
| 6,818,845 | B2 | 11/2004 | Portmann |
| 6,831,988 | B2 | 12/2004 | Vonlanthen |
| 7,003,876 | B2 * | 2/2006 | Crawford et al. ..... 29/859 |
| 7,012,200 | B2 | 3/2006 | Møller |
| 7,016,511 | B1 | 3/2006 | Shennib |
| 7,069,063 | B2 | 6/2006 | Halkosaari et al. |
| 7,117,286 | B2 | 10/2006 | Falcon |
| 7,194,101 | B2 | 3/2007 | Vonlanthen |
| 7,248,712 | B2 | 7/2007 | Gabathuler |
| 7,260,232 | B2 | 8/2007 | Shennib |
| D560,808 | S | 1/2008 | Jurkiewicz et al. |
| 7,349,741 | B2 | 3/2008 | Maltan et al. |
| 7,394,911 | B2 | 7/2008 | Joergensen et al. |
| 7,440,579 | B2 | 10/2008 | Vonlanthen |
| 7,477,753 | B2 | 1/2009 | Buckley et al. |

(Continued)

FOREIGN PATENT DOCUMENTS

| | | | |
|---|---|---|---|
| DE | 3723809 | A1 | 1/1989 |
| DE | 10228828 | C1 | 10/2003 |

(Continued)

OTHER PUBLICATIONS

Office Action dated Sep. 5, 2012 in U.S. Appl. No. 12/972,349.

*Primary Examiner* — Deborah Malamud
(74) *Attorney, Agent, or Firm* — Henricks, Slavin & Holmes LLP

(57) ABSTRACT

A hearing assistance system includes a hearing assistance unit, with an interface for receiving a removable module, and a removable module configured to be retained in the interface.

26 Claims, 7 Drawing Sheets

U.S. PATENT DOCUMENTS

| | | | | |
|---|---|---|---|---|
| 7,529,587 | B2 | 5/2009 | Single | |
| 7,566,296 | B2 | 7/2009 | Zimmerling et al. | |
| 7,578,628 | B2 | 8/2009 | Sherman et al. | |
| 7,602,929 | B2 | 10/2009 | Topholm et al. | |
| 7,729,774 | B1 | 6/2010 | Lynch et al. | |
| 7,751,898 | B2 | 7/2010 | Ibrahim et al. | |
| 2001/0046808 | A1 | 11/2001 | Jorgensen et al. | |
| 2003/0057075 | A1 | 3/2003 | Portmann | |
| 2004/0012470 | A1 | 1/2004 | Zimmerling et al. | |
| 2004/0052388 | A1 | 3/2004 | Niederdrank | |
| 2004/0159535 | A1 | 8/2004 | Wagner | |
| 2004/0252855 | A1 | 12/2004 | Vasserman et al. | |
| 2005/0008178 | A1 * | 1/2005 | Joergensen et al. | 381/322 |
| 2006/0126876 | A1 | 6/2006 | Shennib | |
| 2007/0127757 | A2 | 6/2007 | Darbut et al. | |
| 2007/0154042 | A1 | 7/2007 | Buckley et al. | |
| 2007/0171013 | A1 | 7/2007 | Fujimori et al. | |
| 2007/0253584 | A1 | 11/2007 | Rass | |
| 2008/0060917 | A1 | 3/2008 | Chia-Li et al. | |
| 2008/0232623 | A1 | 9/2008 | Solum et al. | |
| 2008/0288022 | A1 | 11/2008 | Van der Borght et al. | |
| 2009/0123013 | A1 | 5/2009 | Leong | |
| 2009/0239135 | A1 | 9/2009 | Wang et al. | |
| 2009/0325046 | A1 | 12/2009 | Yang | |
| 2010/0032267 | A1 | 2/2010 | Gabathuler et al. | |
| 2010/0260367 | A1 | 10/2010 | Hasler et al. | |
| 2011/0103627 | A1 | 5/2011 | Meier et al. | |

FOREIGN PATENT DOCUMENTS

| | | | |
|---|---|---|---|
| EP | 0573471 | B1 | 10/1994 |
| EP | 0982784 | B1 | 4/2002 |
| EP | 0779015 | B1 | 7/2002 |
| EP | 1271898 | B1 | 1/2003 |
| EP | 1496530 | B2 | 10/2006 |
| GB | 2133133 | A | 7/1984 |
| JP | 05002960 | A | 1/1993 |
| JP | 2003210395 | A | 7/2003 |
| JP | 2009021910 | A2 | 1/2009 |
| WO | WO 9216002 | A1 | 9/1992 |
| WO | WO 9607295 | A1 | 3/1996 |
| WO | WO-9850281 | | 11/1998 |
| WO | WO 2004050166 | A1 | 6/2004 |
| WO | WO 2005048474 | A1 | 5/2005 |
| WO | WO 2005062668 | A1 | 7/2005 |
| WO | WO 2007117721 | | 10/2007 |
| WO | WO 2009118047 | | 10/2009 |
| WO | WO 2009127745 | | 10/2009 |
| WO | WO-2012/103320 | A1 | 8/2012 |

* cited by examiner

HEARING ASSISTANCE SYSTEM

CROSS-REFERENCE TO RELATED APPLICATIONS

This application claims the benefit of U.S. Provisional Application Ser. No. 61/102,726, filed Oct. 3, 2008 and entitled "Removable Module For Hearing Assistance System," which is incorporated herein by reference.

BACKGROUND

In human hearing, hair cells in the cochlea respond to sound waves and produce corresponding auditory nerve impulses. These nerve impulses are then conducted to the brain and perceived as sound.

Hearing loss, which may be due to many different causes, is generally of two types: conductive and sensorineural. Conductive hearing loss typically occurs where the normal mechanical pathways for sound to reach the hair cells in the cochlea are impeded, for example, from damage to the ossicles. Conductive hearing loss may often be helped by using conventional hearing aids that amplify sounds so that acoustic information can reach the cochlea and the hair cells. Some types of conductive hearing loss are also amenable to alleviation by surgical procedures.

Many people who are profoundly deaf, however, have sensorineural hearing loss. This type of hearing loss can arise from the absence or the destruction of the hair cells in the cochlea which then no longer transduce acoustic signals into auditory nerve impulses. Individuals with sensorineural hearing loss are unable to derive any benefit from conventional hearing aid systems no matter how loud the acoustic stimulus is. This is because the mechanism for transducing sound energy into auditory nerve impulses has been damaged. Thus, in the absence of properly functioning hair cells, auditory nerve impulses cannot be generated directly from sounds.

To overcome sensorineural deafness, cochlear implant systems or cochlear prostheses have been developed that can bypass the hair cells located in the vicinity of the radially outer wall of the cochlea by presenting electrical stimulation directly to the auditory nerve fibers. This leads to the perception of sound in the brain and provides at least partial restoration of hearing function. Thus, most of these cochlear prosthesis systems treat sensorineural deficit by stimulating the ganglion cells in the cochlea directly using an implanted electrode or lead that has an electrode array. Thus, a cochlear prosthesis operates by directly stimulating the auditory nerve cells, bypassing the defective cochlear hair cells that normally transduce acoustic energy into electrical activity to the connected auditory nerve cells.

Prior to stimulating the nerve cells, the electronic circuitry and the electrode array of the cochlear prosthesis separate acoustic signal into a number of parallel channels of information, each representing a narrow band of frequencies within the perceived audio spectrum. Ideally, each channel of information should be conveyed selectively to a subset of auditory nerve cells that normally transmit information about that frequency band to the brain. Those nerve cells are arranged in an orderly tonotopic sequence, from the highest frequencies at the basal end of the cochlear spiral to progressively lower frequencies towards the apex.

A wide variety of electromechanical devices may be used to treat the various causes of hearing loss. Such devices include, but are not limited to, in-the-ear hearing aids, Behind-The-Ear (BTE) hearing aids, bone conduction hearing aids, body worn, BTE and otherwise external sound processing units, and cochlear implants. A cochlear prosthesis, for example, may typically comprise both an external unit that receives and processes ambient sound waves and an implant that receives data from the external unit and uses that data to directly stimulate the auditory nerve. As used herein, the term "hearing assistance device" is used generally to refer to any of these devices, including hearing aids and external sound processing units that supply data to cochlear implants, that are used to treat all of the various forms of hearing loss.

Hearing assistance devices are typically worn regularly and over a significant period of each day. Consequently, the assistive devices must be robust and reliable. Additionally, the assistive devices should be visually unobtrusive and not unduly restrict the user's activities. Many of these assistive devices have one or more external controls which allow for a number of adjustments to the operation of the device or its processor, such as volume, sensitivity, and program settings.

The present inventors have determined that, while the external controls are important to the proper and comfortable use of the device, they tend to be infrequently needed and may also create a number of issues. For example, external controls can increase the size of the hearing assistance device. Control knobs also take up space and add to the overall size of the device. This makes the device more visible and conspicuous and may make its wearer more self-conscious. External controls can also be weak points which allow the ingress of contaminants and water into the device. If a seal fails on one of the controls, the integrity of the processor could be compromised and the processor would need to be sent back to the manufacturer for repair. External controls can also be easily bumped and moved, resulting in unwanted adjustments to the operation of the device. In particular, children wearing one of these devices may be prone to inadvertently actuating the external controls of a hearing assistance device while at play. A child may also innocently, but intentionally, operate the controls of the hearing assistance device and change the settings without a parent being aware.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

The following is a detailed description of the best presently known modes of carrying out the inventions. This description is not to be taken in a limiting sense, but is made merely for the purpose of illustrating the general principles of the inventions. Reference in the specification to "an embodiment," "an example," or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

The present inventions have a wide variety of applications. One example is a Behind-The-Ear (BTE) external sound processing unit for a cochlear implant and the present inventions are discussed in the context of BTE external sound processing units. The present inventions are not, however, limited to BTE external sound processing units and are instead also applicable to other hearing assistance devices that currently exist, or are yet to be developed. For example, the present inventions are applicable to hearing assistance devices such as hearing aids, bone conduction hearing aids and processors, and body worn sound processing units for cochlear implants.

Figure 1:
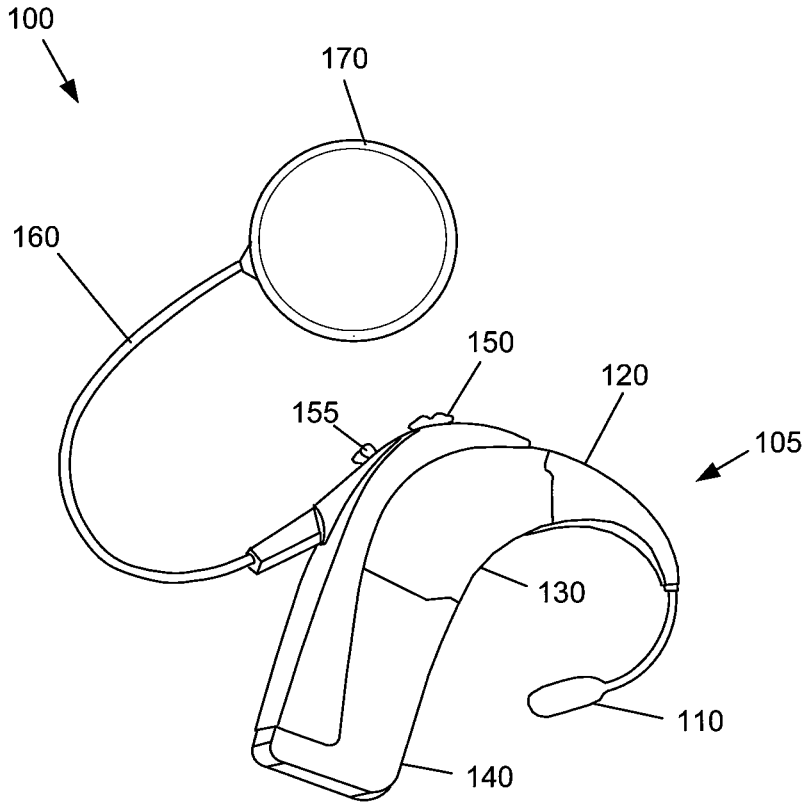
FIG. 1 is an illustrative diagram showing the external components of one embodiment of a cochlear implant system, according to one embodiment of principles described herein.

FIG. 1 is an illustrative diagram showing the external components 100 of one embodiment of a cochlear implant system. Unlike hearing aids, the cochlear implant does not amplify sound, but works by directly stimulating any functioning auditory nerve cells inside the cochlea with electrical impulses.

The external components 100 include a microphone 110, an ear hook 120, sound processor (or "processor") 130, and a rechargeable battery 140. The microphone 110 picks up sound from the environment and converts it into electrical impulses. The processor 130 selectively filters and manipulates the electrical impulses and sends the processed electrical signals through a cable 160 to the transmitter 170.

A number of controls adjust the operation of the processor 130 such as, for example, a volume or sensitivity switch 150 and program selection switch 155. The transmitter 170 receives the processed electrical signals from the processor 130 and transmits these electrical signals to the internal components of the cochlear implant by electromagnetic induction and/or by using radio frequencies.

Figure 2:
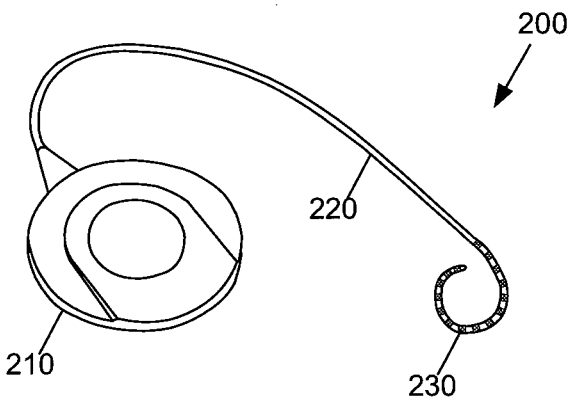
FIG. 2 is an illustrative diagram showing the internal components of one embodiment of a cochlear implant system, according to one embodiment of principles described herein.

FIG. 2 is an illustrative diagram showing the internal components 200 of one embodiment of a cochlear implant system. The internal components 200 include a receiver 210, a cochlear lead 220, and electrodes 230. The internal components 200 are surgically implanted such that the electrode 230 is internal to the cochlea.

The receiver 210 is secured beneath the user's skin, typically above and behind the external ear, with the cochlear lead 220 connecting the receiver 210 to the electrodes 230. The receiver 210 receives signals from the transmitter 170 (FIG. 1) and sends the signals through the cochlear lead 220 to the electrodes 230.

The electrodes 230 are wound through the cochlea and provide direct electrical stimulation to the auditory nerves inside the cochlea. This provides the user with sensory input that is a representation of external sound waves which were sensed by the microphone 110.

Figure 3B:
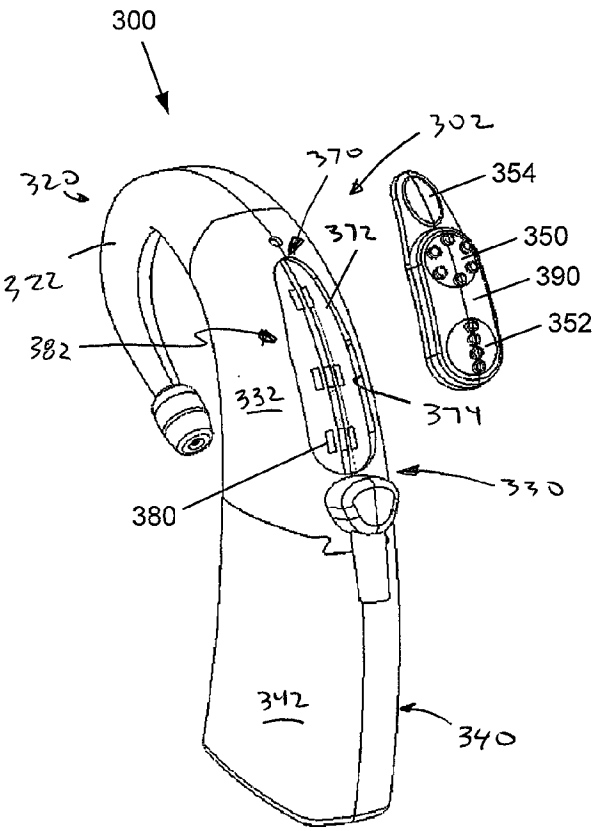
FIGS. 3A and 3B are perspective views of an illustrative BTE unit with a control module, according to one embodiment of principles described herein.
Figure 3A:
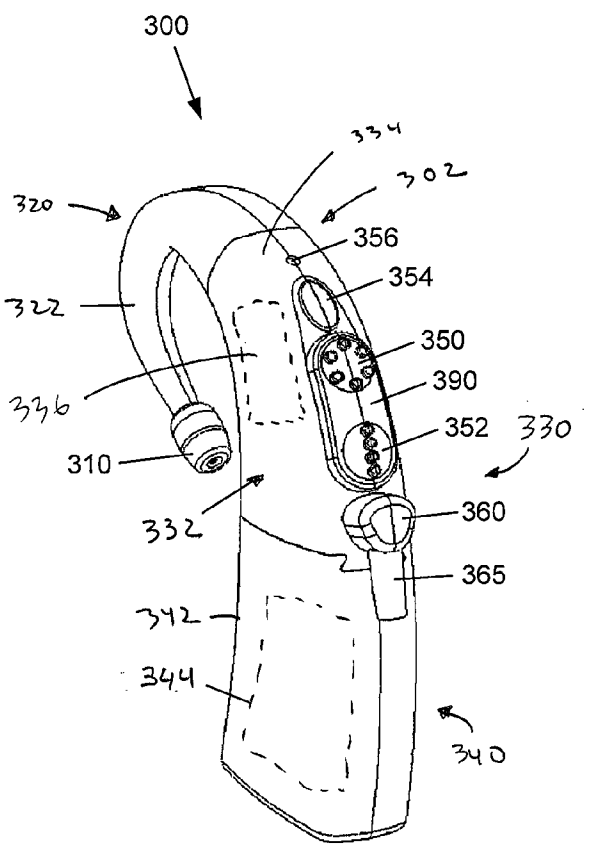

FIG. 3A is a perspective view of an illustrative hearing assistance unit 300, which is a BTE unit in the illustrated embodiment. The exemplary hearing assistance unit 300 includes a hearing assistance unit housing 302, a microphone 310, an ear hook 320, a sound processor (or "processor") 330, a battery 340, and a second microphone 356 which is internal to the processor 330. Additionally, a connector 360 and strain relief 365 allow for a cable connection 160 (FIG. 1) between the hearing assistance unit 300 and the transmitter 170 (FIG. 1).

The exemplary ear hook 320 includes an ear hook housing 322 that supports the microphone 310 and protects the associated wires. The exemplary sound processor 330 includes a sealed processor housing 332 with an interior and an exterior 334. Sound processing components 336 (such as a microprocessor and memory) and, in some instances, a transmitter are located within the housing interior. The exemplary battery 340 includes a battery housing 342 and a power storage device 344 located within the housing. The hearing assistance unit housing 302 is defined by the ear hook housing 322 (if present), the processor housing 332 and the battery housing 342.

The ear hook 320, sound processor 330 and battery 340 may be separate structural units (as shown) and configured such that the ear hook housing 322 and battery housing 342 may be detachably mechanically coupled to the processor housing 322. The ear hook 320, sound processor 330 and battery 340 are provided with suitable electrical connectors to facilitate the connection of the microphone 310 and battery power storage device 334 to the sound processing components 336. In other implementations, sound processor 330 and battery 340 may be combined into an integral unit that share a common housing. Here, the power storage device may removable, and the housing provided with a door, or may be permanent and rechargeable. One example of a hearing assistance unit with a permanent and rechargeable power storage device is disclosed in U.S. Pat. No. 7,349,741, which is incorporated herein by reference. In some implementations, the ear hook 320 and sound processor 330 may be combined into an integral unit that share a common housing. Also, in those instances where the hearing assistance unit is not intended to be worn on the ear (e.g. a body worn unit), the ear hook 320 may be omitted.

The exemplary hearing assistance unit 300 may be combined with a removable module, i.e. the control module 390 in the illustrated embodiment, that may be mechanically secured and electrically connected to the hearing assistance unit housing 302 in the manner described below. The control module 390 is an independently sealed, stand alone, modular device. The control module 390 may include various controls and indicators that assist the user in adjusting and monitoring the hearing assistance unit operation. The exemplary control module 390 is also relatively small and thin, as compared to the hearing assistance unit housing 302, and is configured to be combined with the housing such that the control module appears to be part of the housing. Additionally, in order to facilitate a small size, the exemplary control module 390 does not include instrumentalities (e.g. a power storage device for the hearing assistance unit) that are not associated with control functionality.

There are a variety of advantages associated with the use of a removable control module. By way of example, but not limitation, the control module can be connected to a hearing assistance device in order to adjust settings or otherwise control the hearing assistance device, and then be removed from the hearing assistance device. This prevents inadvertent adjustment of the hearing assistance device. Moreover, the removability of the control module described herein allows for different interfaces to be used in different environments and to serve a variety of purposes. Finally, the use of a separate control module allows for better sealing and protecting of internal components than conventional speech processors with a permanent control panel that may include knobs or other devices that are potential sources of leaks.

A wide variety of control panels may be employed. By way of example and not limitation, the control module 390 may comprise an LED indicator 354, a volume control 350, such as a knob or switch, and a program control 352, such as a knob or switch. A variety of control types can be used on the control module 390. By way of example and not limitation, rotary switches, toggle switches, multiple position switches, momentary switches, push button switches, rocker switches, and other appropriate controls can be used.

The controls 350, 352 may be used for a variety of purposes. For example, a program control 352 may allow a user to switch between various preset modes.

During consultation and testing by an audiologist, the cochlear implant is programmed with a number of preset modes. By way of example and not limitation, a first mode may be optimized for use in environments with high levels of background noise, such as restaurants. A second mode may combine the input from both the microphone 310 and the processor microphone 356. A third mode may be optimized for conversations in a quiet environment.

The program control 352 allows the user to select the mode best suited for the particular environment. Alternatively, the processor 330 may switch between various modes automatically based on the audio input received from the microphones 310, 356. Similarly, the volume control 350 allows the user to adjust the overall volume of the output signal.

The LED indicator 354 can be particularly useful for pediatric situations where the child is unable or unwilling to communicate the status of the device. For example, the LED indicator 354 may display a specific color and light pattern for: normal operation, a current operating mode, a processor fault, a transmission fault, or a low battery. In this way, the caregiver is visually alerted to the operating status of the assistive device and can provide the necessary support to the child.

FIG. 3B shows the control module 390 removed from the hearing assistance unit housing 302 to expose the underlying recess 370 and electrical contacts 380, which together define an hearing assistance unit interface 382. The underside of the control module 390 includes a plurality of electrical contacts that mate with the interface electrical contacts when the control module is received by the interface. Removal of the control module 390 from the hearing assistance unit 300 can be useful for a variety of reasons. For example, in pediatric situations, the control module 390 can be removed to prevent the controls from being inadvertently adjusted by the child or to prevent the controls from being bumped or snagging on objects in the environment. In other situations, the user may have optimized the program settings and desires to make the assistive device less obtrusive. To that end, it should be noted that the hearing assistance unit 300 functions without the control module 390 or cover 400 (discussed below) or receiver 500 (discussed below).

The interface recess 370 includes a bottom wall 372 that supports the electrical contacts 380 and a side wall 374 that extends around the perimeter of the recess. The interface 382 defined by the recess 370 and electrical contacts 380 is a sealed, watertight interface. The control module 390 may be secured to the housing 302, when within the recess 370, in a variety of ways. For example, the respective size, shape and material properties of the recess 370 and the control module 390 may be such that the control module will be secured to the housing 302 by an interference or compression fit between the side wall 372 and the perimeter surface of the control module 390 when the control module is inserted into the recess. Other instrumentalities for securing the control module 390 to the housing 302 include, but are not limited to, mechanical latches and magnets. The walls 372 and/or 374 of the recess 370 and the inserted control module 390 form a seal between the inserted module and the housing of the hearing assistance unit 300. The seal between the inserted module and the housing of the hearing assistance unit 300 may be watertight or water resistant and prevent contaminants from entering the hearing assistance unit or shorting the electrical contacts 380. A gasket, which may be associated with the recess 370 or the control module 390, may be used to augment the seal.

As described in, for example, the preceding paragraph, the structure which performs the function of mechanically securing the control module to the interface 382 and forming a seal between the control module and the interface may be the surface of the side wall 374 and the perimeter surface of the control model 390 that engages the side wall. Other structures for performing part or all of this function include, but are not limited to, latches and other fasteners, magnets and gaskets.

The interface 382 is associated with the processor housing 332 in the illustrated embodiment. In other embodiments, including but not limited to those in which the processor and battery housings are integral, the interface may be located on other portions of the hearing assistance device housing. For example, the interface may be located on the portion of the hearing assistance device housing associated with the power storage device.

The use of a control module 390, as described above, also provides a number of other benefits. The control module 390 can incorporate a number of additional electrical components associated with the operation of the controls 350 that normally reside within the processor 330. This allows additional room within the processor 330 for added electronics or a reduction in the overall size of the processor 330. Additionally, the control module 390 could contain other features. For example, an LED status light could be useful for pediatric patients, but would not be necessary for adults. Consequently, different versions of a control module 390 could be attached to a BTE unit during fitting to customize it for the specific patient.

Further, according to one embodiment, the control module 390 is independently waterproof, which makes waterproofing the unit 300 much easier. The modularity of the control module 390 can also decrease the cost and disruption of repairs. For example, if a seal fails at any point on the control module 390, it can be replaced without having to return the entire unit 300. The unit 300 can continue to be used with its present settings or can be programmed using an alternative method or control module.

Figure 4B:
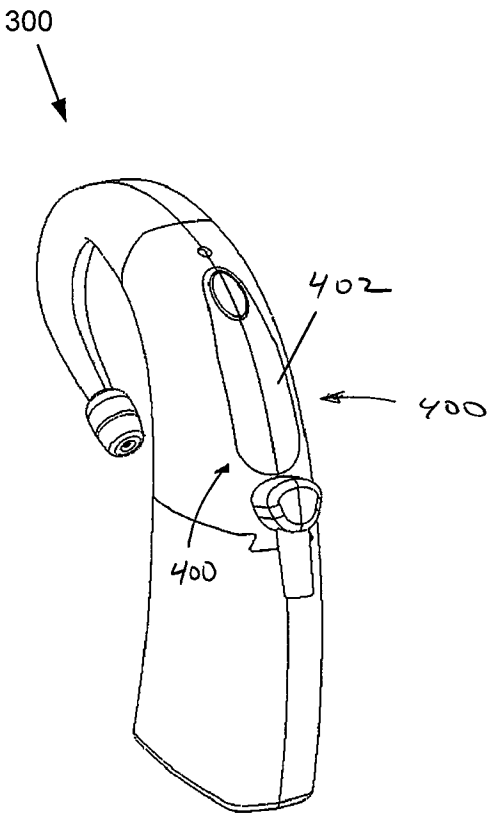
FIGS. 4A and 4B show the placement of an illustrative cover onto a BTE unit after a control module is removed, according to one embodiment of principles described herein.
Figure 4A:
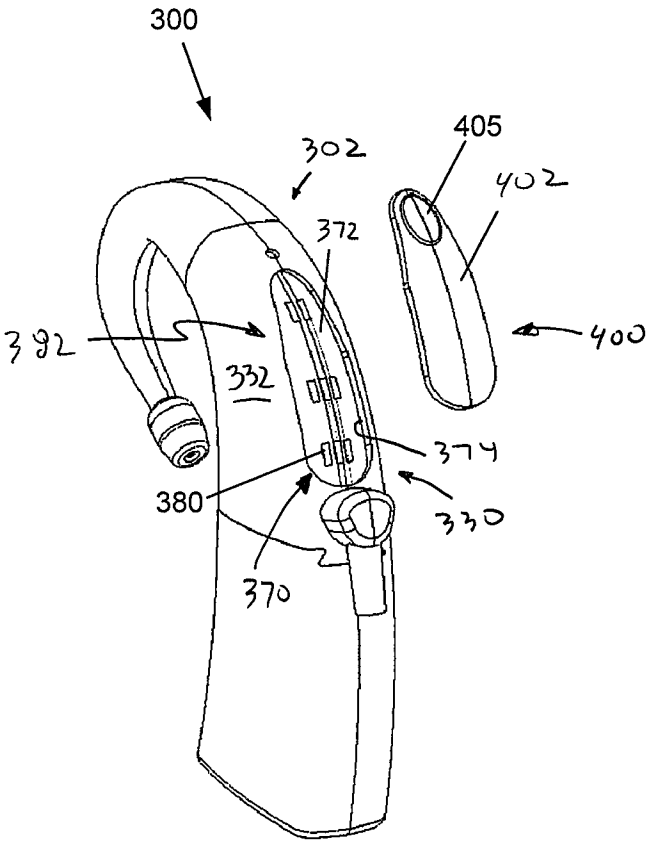

FIGS. 4A and 4B respectively show the placement of a cover 400 and the profile of the hearing assistance unit 300 after the cover is attached to the hearing assistance unit housing 302 at the interface 382. When no control module is being used in the hearing assistance unit 300, the cover 400 may be attached to the processor 330 to cover the interface electrical contacts 380 and fill the recess 370. To that end, the cover 400 may be configured to be secured to the interface 382 in manner described above with reference to the module 390. The resulting profile of the hearing assistance unit 300 appears smaller and sleeker than when external controls are present. Further, the cover protects the contacts 380 in the recess 370 and increases the mechanical integrity of the seal contained in the hearing assistance unit 300 shell. By removing the control module 390 and replacing it with the cover 400, unwanted adjustments by a child and accidental bumping of controls are prevented without exposing the electrical contacts 380 to moisture.

It should also be noted that, as used herein, a "cover" is something that does not perform a control function and does not include any control or wireless communication instrumentalities. The illustrated cover 400, for example, consists solely of a plate-like element 402 and (if any) instrumentalities that secure the cover to the hearing assistance unit interface 382. The cover 400 may, however, be provided with a visible indicator 405 (e.g. an LED) and electrical contacts (not shown) so that the hearing assistance unit 300 can provide feedback when, for example, the sound processor is not functioning properly or the battery is low.

Additional protection for the electrical contacts 380 may be provided, in accordance with one of the inventions herein, by selectively disconnecting the electrical contacts from the associated power source. For example, in some embodiments, including both BTE and body worn hearing assistance units, the electrical contacts 380 may be disconnected from the power source when the electrical contacts are uncovered in order to prevent oxidation of the contacts should they come into contact with salts, water or certain chemicals. Disconnecting the electrical contacts 380 from the power source removes the electromotive force that drives chemical corrosion. The disconnection may occur automatically, such as when control module 390, cover 400 or receiver 500 (discussed below) is removed from the interface 382, or may occur in response to a user instruction, such an instruction input with the control panel prior to removing the control module from the interface. With respect to automatic disconnection, the sound processor may include a switch that changes state in response to the presence or absence of a control module (or cover or receiver) at the interface. For example, the switch may be normally closed and configured to open when the control module (or cover or receiver) is removed from the interface, or normally opened and configured to close when the control module (or cover or receiver) is connected to the interface. The switch, in some implementations, may be a magnetically actuated switch and the control module (or cover or receiver) may be provided with a magnet.

Additionally or alternatively, the user may desire to replace the control module 390 with an alternative module. Such an alternative module may include a radio receiver, WiFi receiver, Bluetooth® receiver, IEEE 802.11 receiver, or another module which receives a signal and relays that signal to the processor 330. These alternative modules may all have the same mechanical and electrical connection mechanisms as the control module 390 and be received within the recess 370 and by the interface 382 in the same way. For example, when the alternative modules are snapped into the interface recess 370 and held there with an interference fit, the interface electrical contacts 380 mate with corresponding electrical contacts on the underside of the alternate module in the manner described above with reference to control module 390. According to one illustrative embodiment, the seal formed at the periphery of the recess 370 may be an interference seal or a compression seal that is engaged when a retention mechanism locks the module into place.

A variety of different modules serving different purposes may all be sized to interface with the recess 370 as needed. In one embodiment, a Bluetooth® receiver could be used to listen to music, cell phone calls, or other Bluetooth® compatible devices. In such examples, a sound source, such as a cell phone or music player, transmits a Bluetooth® signal to the Bluetooth® receiver of the alternative module on the hearing assistance device.

Figure 5:
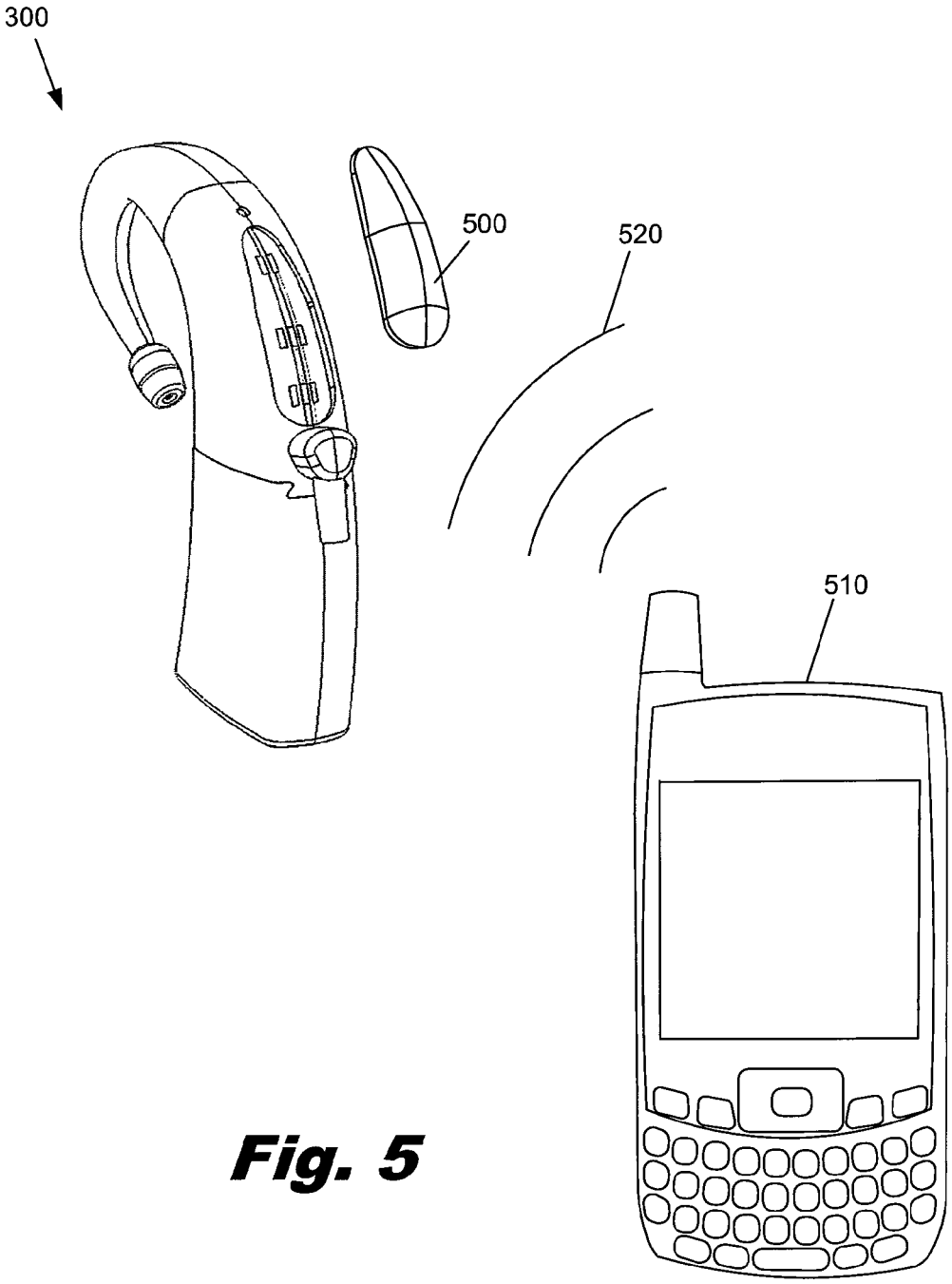
FIG. 5 shows the placement of an illustrative receiver onto a BTE unit after a control module is removed, according to one embodiment of principles described herein.

FIG. 5 shows the placement of an illustrative receiver 500 onto a hearing assistance device 300, perhaps after a control module or cover has been removed. The receiver 500 is configured to receive wireless signals 520 from a cell phone, MP3 player, personal digital assistant (PDA), or other electronic transmitting device 510. In some embodiments, the receiver may receive an electronic audio signal (analog and/or digital) from an entertainment device such as a television, computer or mobile device. The receiver 500 then converts the signal into audio information that is conveyed via the hearing assistance device 300 to the wearer. As indicated above, the hearing assistance device may be a hearing aid, cochlear implant, body worn sound processor or other hearing assistance device.

Using the receiver 500 with the hearing assistance device can result in greater flexibility and convenience for the user who can then have both hands free. For example, the user could then drive while listening to music or a friend via the transmitting device 510. Additionally, the user could have both hands free to communicate using sign language or create text messages. In some circumstances, particularly where the mobile device does not support the conventional T-coil technology commonly used by hearing aids to pick up telephone conversations, the clarity of the communication using the device 510 may be significantly improved by the receiver 500 than if the user were simply relying on the hearing assistance device to transduce actual sound from the device 510.

Figure 6:
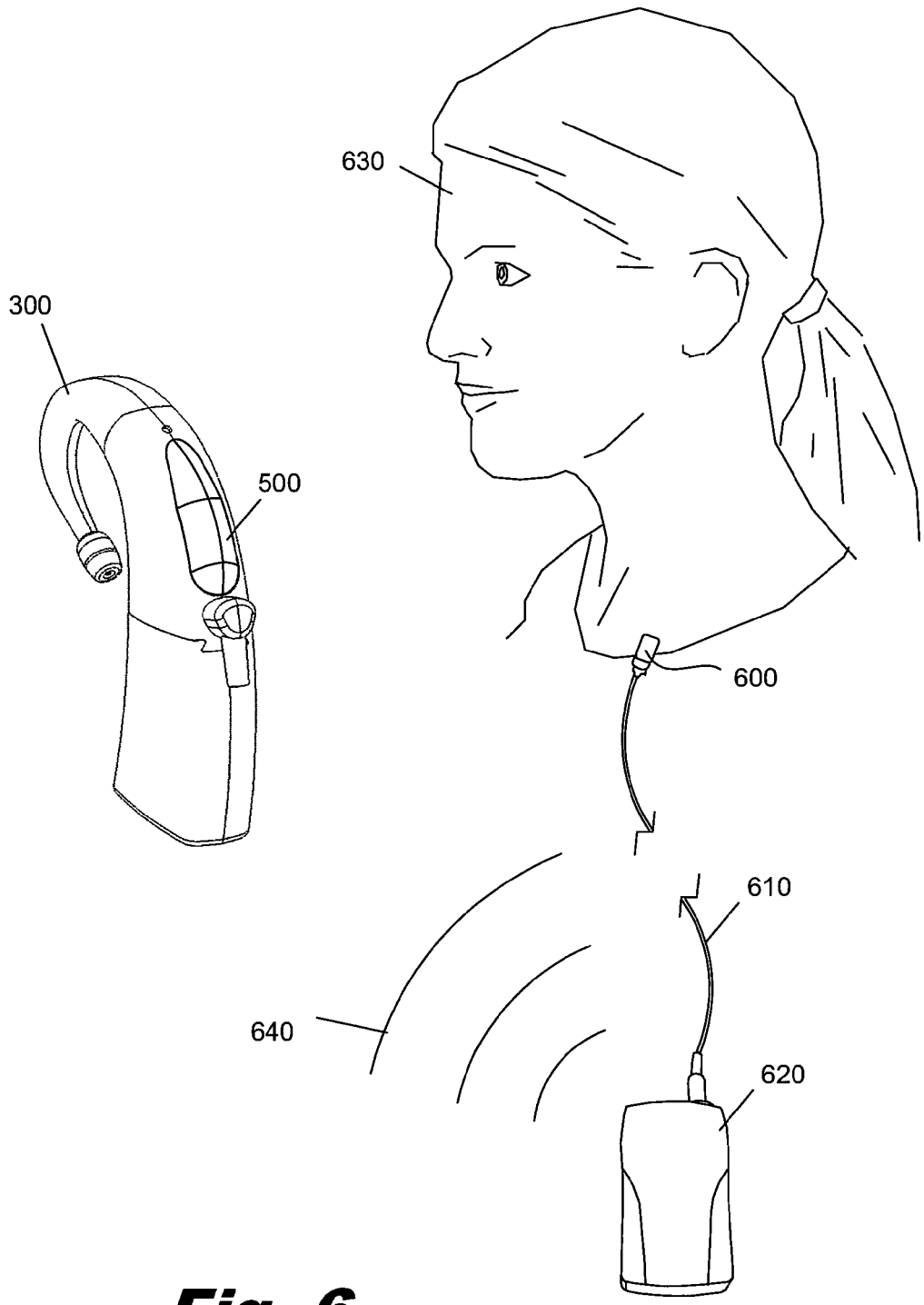
FIG. 6 shows the use of an illustrative receiver with a wireless microphone, according to one embodiment of principles described herein.

FIG. 6 shows the use of an illustrative receiver 500 attached to a hearing assistance device 300 that is configured to receive RF signals or infrared signals 640 generated by a wireless microphone 600. For example, a radio frequency receiver 500 used in a classroom setting might be used in conjunction with a wireless microphone 600 worn by a teacher 630. According to one illustrative embodiment, sound detected by the microphone 600 converted into an electrical signal which passes through a cable 610 to a base unit 620 worn on the teacher's person. The base unit 620 may then transmit a wireless signal 640 directly to the receiver 500. Additionally or alternatively, the wireless signal 640 may be transmitted to a larger base station for signal modification and rebroadcast. The communication between the receiver 500 and the wireless microphone 600, 610, 620 could use a number of wireless protocols including, but not limited to, frequency modulation (FM) transmission, infrared communication, WiFi, Bluetooth®, or IEEE 802 technologies.

This wireless microphone arrangement may significantly improve the user's ability to understand instructions compared to having a microphone located at the hearing assistance device 300 itself. When the user is no longer in the classroom setting, the alternative module with the radio frequency receiver 500 can be removed and replaced with a cover or other control module as described herein.

Figure 7:
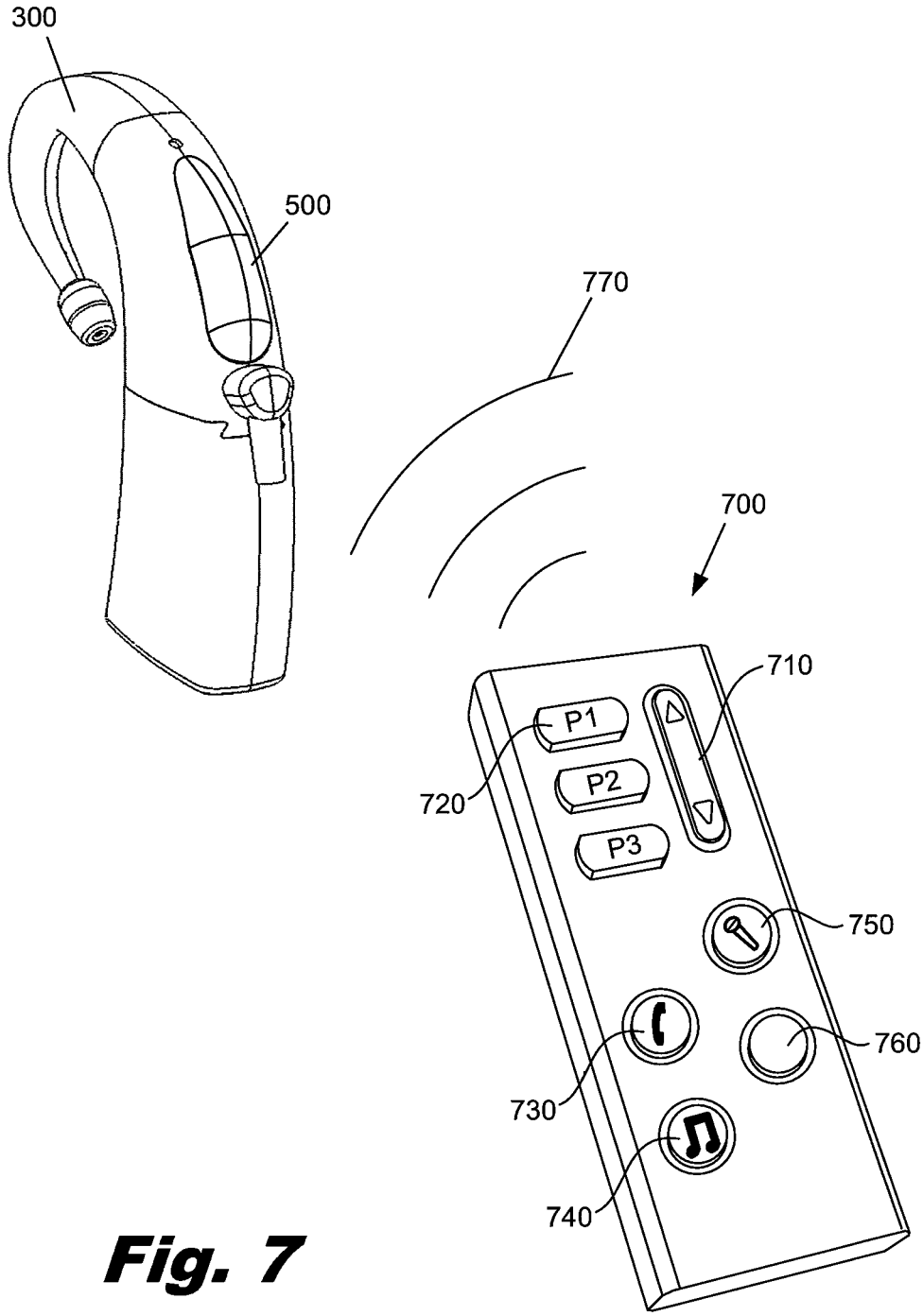
FIG. 7 shows the use of an illustrative receiver with a wireless gateway device, according to one embodiment of principles described herein.

FIG. 7 shows the use of an illustrative receiver 500 with a wireless gateway device 700. The gateway device 700 may take the form of a small remote or key fob which the user can manipulate to send the desired signals or commands to the hearing assistance device 300 via the receiver 500. For example, the gateway device 700 may be a remote control device comprising user controls that when manipulated cause the remote control device to transmit a control signal to the receiver 500. Consequently, the gateway device 700 may allow the user more convenience in adjusting the operation of hearing assistance device 300. The larger controls may be particularly useful for older users who have difficulty manipulating the much smaller controls residing on the hearing assistance unit 300. The gateway device 700 may include program buttons 720 for changing between a number of preset programs generated by an audiologist and stored within the hearing assistance device 300. The gateway device 700 may also contain a volume or sensitivity control 710. In some embodiments, the gateway device 700 may contain more extensive programming controls, such as control over the amplification of specific frequency bands, test features, and other functions.

Additionally or alternatively, the gateway device 700 may also provide access to a number of other devices within a personal or home network. For example, the gateway device 700 may have a telephone button 730 which can be pressed to transmit the audio information from a cell phone, telephone, or answering machine directly to the receiver 500. In other embodiments, the gateway device 700 may receive the telephone signal and retransmit the signal to the receiver 500. Additionally, the gateway device 700 may be configured to manipulate, transform, transcode, or otherwise operate on the information it receives. The gateway device 700 may also have an entertainment button 740 which directs information from an entertainment center, stereo, home theater, MP3 player, or other device to the receiver 500. The receiver 500 and gateway device 700 may also be used to provide the user with hearing/speech training materials that facilitate patient training and testing at home.

The gateway device 700 may include a microphone button 750 which switches the audio signal transmitted to the receiver 500 to a wireless microphone worn by another individual. Particularly in noisy environments, such as restaurants, the audio clarity of a microphone can significantly improve the ability of a hearing impaired person to communicate. According to one illustrative embodiment, the wireless microphone may be contained directly within the gateway device 700. After the user presses the microphone button 750, the gateway device 700 is placed in proximity to the other person in the conversation. For example, the gateway device 700 could be placed on the table or in the shirt pocket of the other person in the conversation. Additionally or alternatively, the gateway device 700 could interface with separate wireless devices that are worn by one or more individuals in the group. For example, the gateway device 700 could interface via Bluetooth® to a number of earpieces/microphones that are commonly used with hands-free cell phone configurations.

In one illustrative embodiment, the gateway device 700 may contain a directional microphone which can be pointed by the user at the location or person the user desires to hear. Because the microphone is directional, it does not pick up the majority of the background noise and preferentially amplifies sounds from the desired location. The directional microphone could provide more flexibility for the user in selecting the origin of the received sound. For example, in a collaborative group setting, such as a business meeting, classroom, convention, or court room it may be inconvenient to instrument each of the speakers with a separate microphone. Instead, the user could selectively point the directional microphone at the current speaker.

The gateway device 700 may also contain one or more detachable wireless microphones that can be removed from the gateway device 700 and attached to the clothing of other individuals in the group. These wireless microphones would then pick up the voice of the wearer and transmit the audio signals to the gateway 700 and/or the receiver 500. When the wireless microphone is replaced into its receptacle within the gateway device, it can be recharged from the gateway device's power source, for example, a battery which can also be recharged or replaced as needed.

The gateway device 700 may have connectivity to a number of other devices which generate audio signals. These alternative devices may be accessed by additional controls 760 contained within the gateway device.

The gateway device 700 may also store a complete backup (or "image") of the software contained on the associated BTE or body worn sound processor or other hearing assistance device. The backup could include all of the software associated with the hearing assistance device, or a subset thereof such as the settings and/or modes for that particular user determined during the fitting process. Should the hearing assistance device be lost, damaged, or otherwise require replacement, the replacement hearing assistance device could be shipped uninitialized to the patient and the gateway device could be used to program the new hearing assistance device so that it operates in the same manner as the device that was replaced.

According to one illustrative embodiment, a gateway device may be created by downloading specialized software onto a capable mobile device, such as mobile digital assistant. The existing connectivity of the mobile digital assistant can be used to access personal, home, and global networks. By way of example, mobile digital assistants may have communication capabilities using cell phone networks, WiFi, Bluetooth®, universal serial bus connections, infrared, serial ports, Ethernet ports, global positioning system (GPS), wireless local area networks (WLAN), IEEE 802 protocols, and others. The gateway device functionally could then be implemented using the existing mobile digital assistant. For example, the mobile digital assistant could be used to control/program the hearing assistance device. Additionally, the mobile digital assistant would receive the data representing audio signals from various sources, perform signal processing or other functions, and then transmit the information to the receiver on the hearing assistance device. This would reduce the expense associated with purchasing a separate gateway device and be more convenient for the user, who would have one less device to carry and manage.

A gateway device (e.g. gateway device 700) may also be configured to pair with a plurality of BTE or body worn sound processors or other hearing assistance devices. The sound processors may, for example, have unique identifiers and the gateway device may be configured to pair with one, some or all of the sound processors. Such a gateway device may be used, for example, in an educational setting to facilitate communication between an instructor and a number of students. Communication may be unidirectional, i.e. from the gateway device to the sound processor, or bidirectional in those instances where a sound processor had a buzzer or other communication instrumentality.

A gateway device that includes a display (e.g. a gateway device created by downloading specialized software onto a capable mobile device such as mobile digital assistant or mobile telephone) may be provided with a speech to text algorithm to provide users with visible text of words received by the sound processor. Such functionality is useful in, for example, difficult listening situations.

The receiver 500 is only one example of an alternative module which could replace the sealed modular control unit. Other alternative modules could include a memory/recording module. The memory/recording module could record segments of the auditory information received by the hearing assistance device or segments of the auditory data output to the user. For example, the memory/recording module could use Motion Pictures Experts Group Audio Layer 3 (MP3) compression and a memory chip to hold the compressed audio information. Where the memory/recording module records only the output of the hearing assistive device, specialized compression algorithms could be used.

The recorded auditory data could be used in a variety of ways. For example, memory/recording module could be removed and the data transferred to a computing device which would use voice recognition techniques to produce a transcript of the conversations. This would provide hearing impaired users an opportunity to visually review conversations, presentations and lectures. Additionally or alternatively, the memory/recording module could provide an instant replay of the audio information. Rather than ask the speaker to repeat what was said, the user could listen to a short segment of the recorded audio information. Another use for the recorded information could be monitoring the functionality of the hearing assistive device and/or supportive equipment. A parent or audiologist of a hearing impaired child can only guess what the child actually hears and the effectiveness of any support equipment (such as wireless microphones). By recording the input and/or output of the hearing assistance device, it can be determined if the desired audio signals are reaching the hearing assistive device and if the hearing assistive device is properly processing the received signals.

Figure 8:
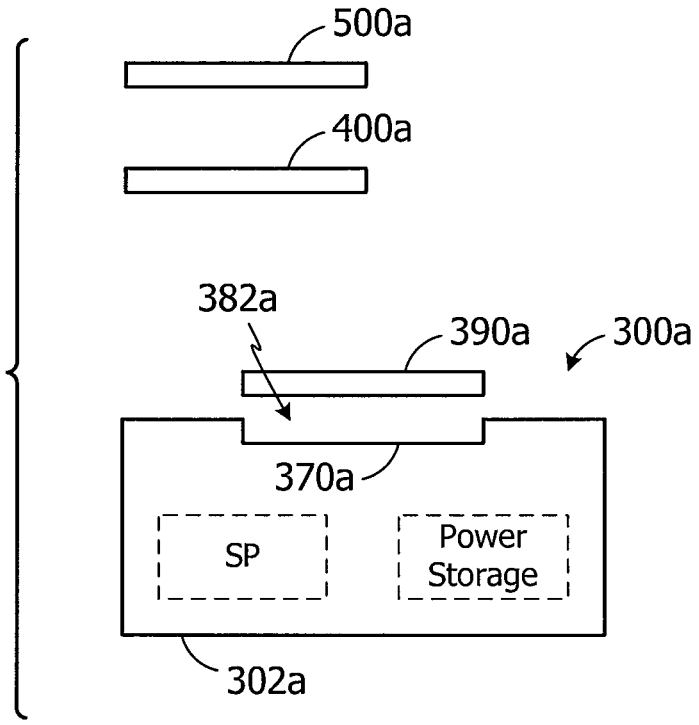
FIG. 8 shows a block diagram of a body worn hearing assistance unit according to one embodiment of the principles described herein.

Turning to FIG. 8, one example of a body worn hearing assistance unit is generally represented by reference numeral 300*a*. The exemplary hearing assistance unit 300*a* is substantially similar to hearing assistance unit 300, but for the fact that the housing 302*a* is configured to be worn on the body as opposed to behind the ear, and similar elements are represented by similar reference numerals. For example, the exemplary hearing assistance unit 300*a* includes sound processor circuitry and a power storage device within a common housing 302*a*. The housing 302*a* includes an interface 382*a* with a recess 370*a* and electrical contacts (not shown). A removable control module 390*a* with corresponding electrical contacts (not shown), which operates in the manner described above with respect to control module 390, may be received by the interface 382*a*. Alternatively, the interface 382*a* may be covered by a cover 400*a* or receive a receiver 500*a*, which operate in the manner described above with reference to the cover 400 and receiver 500. Examples of body worn hearing assistance units are disclosed in U.S. Pat. Nos. 6,272,382 and D560,808, which are incorporated herein by reference.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A hearing assistance system, comprising:

a hearing assistance unit including an external hearing assistance unit housing defining an interior and an exterior, the interior including sound processing components and a power storage device and the exterior including an interface that has at least one hearing assistance unit electrical connector;

a removable cover configured to be received by the interface and cover the at least one hearing assistance unit electrical connector; and a removable module, configured to be received by the interface in place of the removable cover when the removable cover is removed from the hearing assistance unit, including at least one module electrical connector located and configured such that the at least one module electrical connector is electrically coupled to the at least one hearing assistance unit electrical connector when the removable module is received by the interface;

at least one of the hearing assistance unit and the removable module being configured such that the removable module will be mechanically connected to the hearing assistance unit when the removable module is received by the interface and such that the removable module can be mechanically disconnected from, and removed from, the hearing assistance unit after being mechanically connected to the hearing assistance unit; and at least one of the hearing assistance unit and the removable cover being configured such that the removable cover will be mechanically connected to the hearing assistance unit in such a manner that moisture is substantially prevented from entering the interface when the removable module is received by the interface and such that the removable cover can be mechanically disconnected from, and removed from, the hearing assistance unit after being mechanically connected to the hearing assistance unit.

2. The hearing assistance system of claim 1, wherein the removable module comprises a control module, including at least one external control, configured to transmit a control signal to the hearing assistance unit through the interface that changes an operating parameter of the hearing assistance unit in response to manipulation of the at least one external control.

3. The hearing assistance system of claim 1, wherein the interface comprises a recessed interface.

4. The hearing assistance system of claim 1, wherein a water tight seal is formed between the removable module and the interface when the removable module is received by the interface.

5. The hearing assistance system of claim 1, wherein the removable module comprises a receiver configured to receive a wireless signal and transmit data from the wireless signal to the hearing assistance unit through the interface.

6. The hearing assistance system of claim 4, wherein the wireless signal is an electronic audio signal and the receiver is configured to process the electronic audio signal and transmit resulting audio data to the hearing assistance unit through the interface.

7. The hearing assistance system of claim 6, further comprising a mobile phone configured to transmit the electronic audio signal to the receiver.

8. The hearing assistance system of claim 6, further comprising a microphone configured to transmit the electronic audio signal to the receiver.

9. The hearing assistance system of claim 6, further comprising a music player configured to transmit the electronic audio signal to the receiver.

10. The hearing assistance system of claim 6, further comprising an entertainment device configured to transmit the electronic audio signal to the receiver.

11. The hearing assistance system of claim 6, wherein the wireless signal is a control signal and the receiver is configured to transmit control data from the control signal to the hearing assistance unit to control an operating parameter of the hearing assistance unit.

12. The hearing assistance system of claim 1, further comprising:

a cochlear implant adapted to receive signals from the hearing assistance unit.

13. The hearing assistance system of claim 1, wherein the at least one hearing assistance unit electrical connector comprises at least one electrical contact; and at least one module electrical connector comprises at least one electrical contact.

14. The hearing assistance system of claim 1, wherein the interface and the removable module are configured such that an interference fit is formed therebetween when the removable module is received by the interface.

15. The hearing assistance system of claim 1, a substantially watertight seal is formed between the removable cover and the interface when the removable cover is received by the interface.

16. The hearing assistance system of claim 15, wherein the interface and the removable module are configured such that an interference fit is formed therebetween when the removable module is received by the interface; and the interface and the removable cover are configured such that an interference fit is formed therebetween when the removable cover is received by the interface.

17. The hearing assistance system of claim 15, wherein the removable module comprises a removable receiver module configured to receive a wireless signal and transmit data from the wireless signal to the hearing assistance unit through the interface; and at least one of the interface and the removable receiver module being configured to mechanically secure the removable receiver module to the interface and form a substantially watertight seal therebetween.

18. The hearing assistance system of claim 17, wherein the wireless signal is an electronic audio signal and the removable receiver module is configured to process the electronic audio signal and transmit resulting audio data to the hearing assistance unit through the interface.

19. The hearing assistance system of claim 18, further comprising:

a mobile electronic device configured to transmit the electronic audio signal to the removable receiver module.

20. The hearing assistance system of claim 17, wherein the wireless signal is a control signal and the removable receiver module is configured to transmit control data from the control signal to the hearing assistance unit to control an operating parameter of the hearing assistance unit.

21. The hearing assistance system of claim 20, further comprising:

a remote control device comprising user controls that when manipulated cause the remote control device to transmit the control signal.

22. The hearing assistance system of claim 15, further comprising:

a cochlear implant adapted to receive signals from the hearing assistance unit.

23. The hearing assistance system of claim 1, wherein the removable cover does not carry any control instrumentalities.

24. A hearing assistance system, comprising:

a hearing assistance unit including an external hearing assistance unit housing defining an interior and an exterior, the interior including sound processing components and a power storage device and the exterior including an interface that has at least one hearing assistance unit electrical connector;

a removable receiver configured to be received by the interface and to receive a wireless control signal and transmit control data from the wireless control signal to the hearing assistance unit through the interface to control an operating parameter of the hearing assistance unit, the removable receiver including at least one receiver electrical connector located and configured such that the at least one receiver electrical connector is electrically coupled to the at least one hearing assistance unit electrical connector when the removable receiver is received by the interface;

at least one of the interface and the removable receiver being configured to mechanically secure the removable receiver to the interface; and a remote control device including user controls that when manipulated cause the remote control device to transmit the wireless control signal.

25. The hearing assistance system of claim 24, wherein the hearing assistance unit includes hearing assistance unit software stored on a machine-readable medium; and the remote control device stores a backup of the hearing assistance unit software.

26. The hearing assistance system of claim 24, wherein the remote control device stores training material.

* * * * *